US005813084A

United States Patent [19]

Hadaway

[11] Patent Number: 5,813,084

[45] Date of Patent: Sep. 29, 1998

[54] GOLF CLUB FACE CLEANER

[76] Inventor: Todd Hadaway, 9239 Avon Belden Rd., North Ridgeville, Ohio 44035

[21] Appl. No.: 948,441

[22] Filed: Oct. 10, 1997

Related U.S. Application Data

[63] Continuation of Ser. No. 612,997, Mar. 8, 1996, abandoned.

[51] Int. Cl.[6] ..... A47L 13/02; A63B 57/00

[52] U.S. Cl. ..... 15/236.05; 30/169; 473/406; D32/46

[58] Field of Search ..... 15/236.01, 236.05–236.09; 473/406, 408; D21/234; D32/40, 46–49; 30/169, 172

[56] References Cited

U.S. PATENT DOCUMENTS

| | | | |
|---|---|---|---|
| 718,534 | 1/1903 | Shedd | D32/49 X |
| 925,259 | 6/1909 | Ziegler | 15/236.01 X |
| 4,516,773 | 5/1985 | Martin | 473/406 X |
| 4,908,899 | 3/1990 | Killen | 15/236.05 X |
| 5,099,540 | 3/1992 | Paschetto | 15/236.01 X |

FOREIGN PATENT DOCUMENTS

| | | | |
|---|---|---|---|
| 69412 | 5/1892 | Germany | 15/236.01 |
| 4312985 | 10/1994 | Germany | 15/236.01 |
| 127180 | 1/1950 | Sweden | 15/236.05 |
| 2049438 | 12/1980 | United Kingdom | 273/32 A |

*Primary Examiner*—Mark Spisich
*Attorney, Agent, or Firm*—Calfee, Halter & Griswold LLP; Carmen R. Adams

[57] ABSTRACT

This invention relates to a golf club groove cleaner which has a series of edges formed into a polygonal shape, the tool being attachable to a golf glove so as to associate it with the golfer.

10 Claims, 2 Drawing Sheets

GOLF CLUB FACE CLEANER

This application is a continuation of application Ser. No. 08/612,997 filed on Mar. 8, 1996 now abandoned.

BACKGROUND OF THE INVENTION

This invention relates to golf club groove cleaning tools. These tools are designed to remove the accumulated debris in the grooves on the face of the golf club to thus improve the contact between the club and golf ball.

A properly maintained golf club head with clean grooves will provide the golfer with the capacity to control al hook or slice or straight down the fairway together with the amount of desirable spin. However, during the course of a game of golf, the grooves become packed full of matter found on a golf course, i.e. sand, dirt, mud, and grass. This compromises the golfer's control of the game.

Due to the desire to keep the grooves clean, golfers resort to using golf tees, knives, and other implements in an attempt to clean the grooves of the golf club. Unfortunately, the cleaning provided by these implements is typically less than perfect (for example the typical golf tee has a rounded end which is too broad to properly clean every crevice) and could even possibly deform the grooves of the golf club (for example, if a knife or other solid metallic item is utilized). In either instance, the performance of the golf club is compromised and, in some cases, permanently.

The U.S. Pat. No. Des. 328,117, U.S. Pat. No. Des. 347,872, Utility 4,908,997 and Utility 5,007,129 are typical prior art cleaners.

OBJECTS AND ADVANTAGES OF THE INVENTION

It is an object of the present invention to provide a tool that is ergronomically and physically effective in removing built up debris in the grooves of the golf club face.

It is a further object of the present invention to provide the golfer with an excellent source of a green marker that does not get misplaced in a golf bag or cause discomfort while being carried in the pants pocket.

It is yet another object of the invention to provide a tool that can easily be securely attached to the snap on a golf glove providing easy access and manipulation during the game.

It is a further object to provide a tool that has all of the above mentioned features and is high in durability and is long lasting while being easy and inexpensive to manufacture.

Other objects and a further understanding of the invention may be had by referring to the drawings in which:

DESCRIPTION OF THE INVENTION

Figure 1:
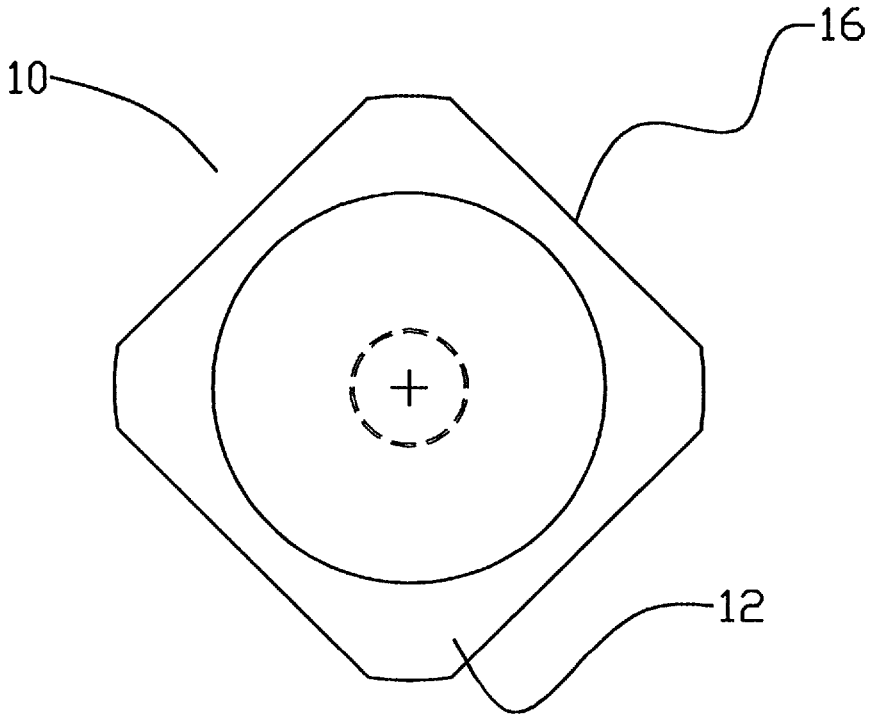
FIG. 1 is a top view of the invented tool.
Figure 2:
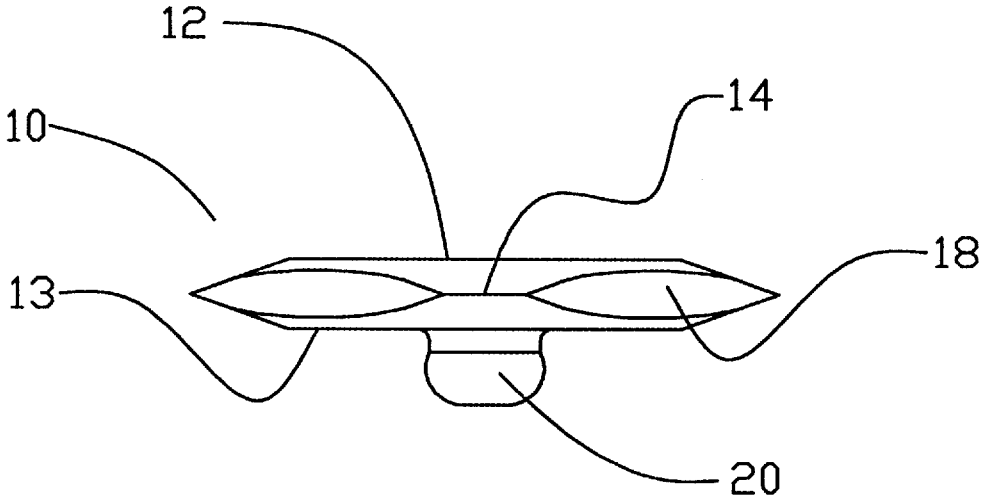
FIG. 2 is a front view of the tool of FIG. 1.
Figure 3:
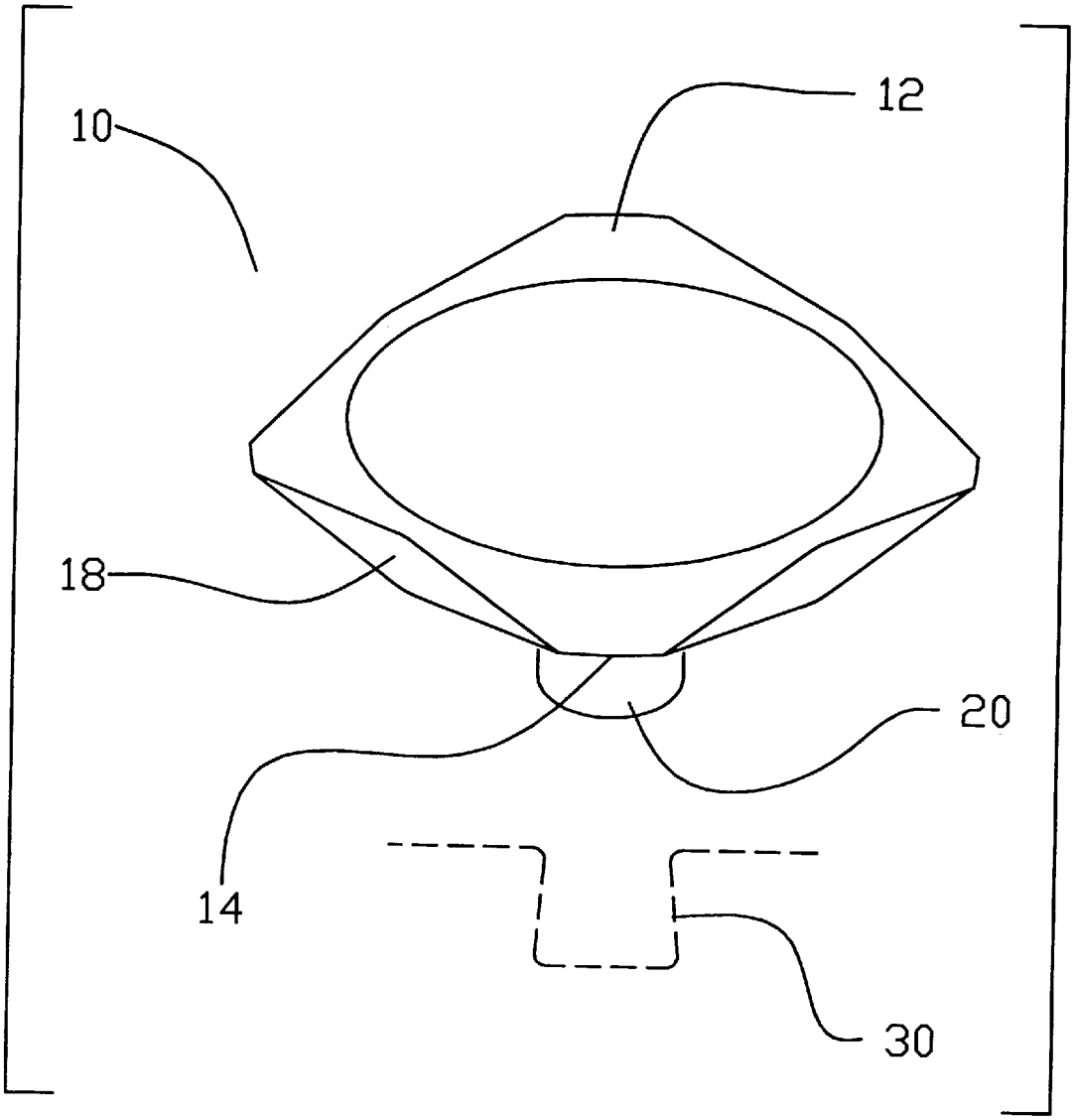
FIG. 3 is an exploded view of the tool of FIGS. 1 and 2 positioned for attachment to a female snap receiver.

The present invention relates to a tool which is useful for cleaning the grooves in the face of a golf club head and removing debris therefrom. Referring to FIGS. 1, 2 and 3, the particular golf club face cleaning tool 10 comprises a body having a top surface 12, a bottom surface 13 and a outer peripheral surface 16 defining the boundary of the tool

10. The outer peripheral surface 16 is comprised of a plurality of tapered cleaning edges 14 and a plurality of sidewalls 18. The tool 10 is shaped and sized to provide an effective area for the fingers and thumb to induce sufficient torque to clean the grooves of the golf club face. In the preferred embodiment, the tool 10 also comprises a button/knob protrusion 20. The protrusion 20 extends from the bottom surface 13 and is shaped so as to act as the male securing agent/device to a female snap receiver 30 provided on a standard golf glove. The tool 10 is substantially flat and can also be effectively used as a ball placement marker without damaging the tool 10 or the green, or injuring any golfer who might step on it. The tool 10 can also be easily carried in a pocket.

In the preferred embodiment, the distance between the top surface 12 and the bottom surface 13 is approximately ⅛ inch. Preferably, the outer peripheral surface 16 has four tapered cleaning edges 14 separated by four sidewalls 18. The top surface 12 and the bottom surface 13 each have the shape of an approximately ½ inch by ½ inch square which is truncated at each of its comers (i.e., the comers of the square are cut off), such that the surface area of both the top surface 12 and the bottom surface 13 is about ¼ $in^2$. The tool 10 is preferably comprised of plastic so as to provide for a non-marring/non-damaging cleaning of the grooves in the golf club face. Further, the plastic construction allows the tool 10 to be attached to a golf glove without physically damaging the glove, or to be carried unobtrusively in a pocket. Generally, the harder the plastic, the longer the life of the tool 10.

According to the present invention, the tool 10 provides the golfer with an effective and efficient means of properly cleaning out the grooves on the golf club face. The tool of the specific preferred embodiment is most effective when placed between the index finger and the thumb for maximum control and torque while removing debris. This invention's cleaning edges sized to be capable of cleaning all sizes of grooves including those made to the Professional Golf Association (PGA) and the United States Golf Association (USGS) rulings—i.e. all grooves in the club faces or golf clubs be no deeper than 0.020 inches and no wider than 0.035 inches at the surface of the club face. The tool 10 can also be designed to clean grooves in other club faces—the tool 10 can be modified as appropriate in order to provide the prerequisite cleaning of the grooves in other non-regulation golf clubs by having edges equal to and/or smaller than the grooves therein. In this respect, it is noted that the particular cleaning tool 10 disclosed has eight edges which can be utilized in succession in order to clean the grooves. As such, the tool is extremely adaptable and amenable to repeated use without compromising the overall functioning of the tool. In this respect, it would be particularly appropriate that the edges which have been used to clean out grooves in the past be utilized for the first pass in respect to any particular groove subsequent with relatively unused edges utilized to complete the task. This increases the longevity of the cleaning tool 10 by allowing new faces to be utilized for follow up or sequential treatment of the golf club, thus lengthening the service life of the cleaning tool 10.

The tool 10 also serves a dual role besides being easily attachable to other standard golf equipment such as golf gloves, clubs, bags, etc. For example, a snap to the very end of a golf club handle would associate the tool automatically with the club. This would be particularly suitable when differing tools are used with differing clubs in a single golf bag. Further, this invented tool 10 for example not only serves effectively as a groove cleaner, but upon separation from the golf glove, etc. also as a very respectable green marker when removal of the golf ball from the playing surface is necessary. When used as such differing colors would preferably be used to distinguish one golfers marker from another.

In addition to the above, the preferred embodiment tool 10 differs from all other, less efficient, tools by having the capacity of being attached to the common golf glove used by a large percentage of golf players golf gloves typically including a female snap receiver 30. The golf glove is rarely forgotten or overlooked by the common player interested in enhanced performance during the game. By associating the tool 10 with the golf glove, it is possible to provide an intuitive, really accessible groove cleaner in conjunction with one of the most commonly known golf accessories. This insures that the groove cleaning tool 10 will be available to the golfer at any particular time without conscious aforethought.

It is preferred that the tool is large enough in size to effectively remove debris from the grooves and serve as a ball marker while being small enough not to hinder the player while attached to the glove, etc. The previously set forth dimensions provide for this. Differing sizes could also be provided to accommodate differing sizes of people (i.e. man vs woman) and differing size club grooves (i.e. large wood vs small putter).

Note the polygonal shape that provides an excellent grip surface and multiple cleaning edges. The edges 14 are usable in sequence to clean the grooves thus lengthening the service life of the tool. The numerous cleaning edges around the sides of the tool and the stud at the base that easily attaches to the common golf groove further increase its adaptability.

Although the invention has been disclosed with a certain degree of particularity in its preferred embodiment, it is to be understood that numerous changes can be made without departing from the invention as hereinafter claimed. For example, the preferred embodiment shows a series of sequential edges extending around the circumference of the tool 10, all amenable to the cleaning of the grooves in the golf club. These edges could be reduced in number to a single edge or could be increased to 16 or more edges without departing from the invention as hereinafter claimed. Further, other connection means other than the snap to a golf glove could be utilized to associate the tool with the golfer. This would include buttons, protrusions, speciality fasteners, and other means of interconnecting the tool to the golfer, his golf bag, or even the clubs themselves.

What is claimed is:

1. A golf club face cleaner for cleaning the grooves in golf club faces comprising a polygonal body having a top surface, a bottom surface and an outer peripheral surface extending entirely around a periphery of the polygonal body defining a boundary of said polygonal body, said outer peripheral surface comprised of a plurality of tapered cleaning edges adapted to fit into and clean a groove in the face of a golf club and a plurality of sidewalls, each of said sidewalls being located between respective pairs of tapered cleaning edges and having a thickness that decreases from a central portion toward opposite ends of said sidewall such that the thickness at the ends of said sidewall is substantially equal to a thickness of the tapered cleaning edges.

2. The golf club face cleaner of claim 1 further comprising a male snap device extending from said bottom surface for engaging and securing to a female snap receiver.

3. The golf club face cleaner of claim 1 wherein said outer peripheral surface is comprised of four tapered cleaning edges separated by four sidewalls defined between said tapered cleaning edges.

4. The golf club face cleaner of claim 2 wherein the distance between said top surface and said bottom surface is about ⅛ inch and wherein said top surface and said bottom surface each have a surface area of about ¼ $in^2$.

5. The golf club face cleaner of claim 2 wherein each of said tapered cleaning edges is adapted to fit into a groove having a depth of about 0.020 inches and a width of about 0.035 inches.

6. A combination golf club face cleaner and golf ball placement marker comprising a polygonal body having a top surface, a bottom surface and an outer peripheral surface extending entirely around a periphery of the polygonal body defining a boundary of said polygonal body, said outer peripheral surface comprised of a plurality of tapered cleaning edges adapted to fit into and clean a groove in the face of a golf club and a plurality of sidewalls, each of said sidewalls being located between respective pairs of tapered cleaning edges and having a thickness that decreases from a central portion toward opposite ends of said sidewall such that the thickness at the ends of said sidewall is substantially equal to a thickness of the tapered cleaning edges.

7. The invention as defined in claim 6 further comprising a male snap device extending from said bottom surface for engaging and securing to a female snap receiver.

8. The invention as defined in claim 7 wherein said outer peripheral surface is comprised of four tapered cleaning edges separated by four sidewalls defined between said tapered cleaning edges.

9. The invention as defined in claim 7 wherein the distance between said top surface and said bottom surface is about ⅛ inch and wherein said top surface and said bottom surface each have a surface area of about ¼ $in^2$.

10. The invention as defined in claim 7 wherein each of said tapered cleaning edges is adapted to fit into a groove having a depth of about 0.020 inches and a width of about 0.035 inches.

* * * * *